US012692674B2

(12) United States Patent
Shao et al.

(10) Patent No.: US 12,692,674 B2
(45) Date of Patent: Jul. 28, 2026

(54) COMPOSITE BOX GIRDER STRUCTURE AND CONSTRUCTION METHOD THEREFOR

(71) Applicant: HUNAN UNIVERSITY, Changsha (CN)

(72) Inventors: Xudong Shao, Changsha (CN); Panpan Li, Changsha (CN); Junhui Cao, Changsha (CN)

(73) Assignee: HUNAN UNIVERSITY, Changsha (CN)

( * ) Notice: Subject to any disclaimer, the term of this patent is extended or adjusted under 35 U.S.C. 154(b) by 524 days.

(21) Appl. No.: 18/346,284

(22) Filed: Jul. 3, 2023

(65) Prior Publication Data

US 2023/0349113 A1 Nov. 2, 2023

Related U.S. Application Data

(63) Continuation of application No. PCT/CN2022/097537, filed on Jun. 8, 2022.

(30) Foreign Application Priority Data

Mar. 30, 2022 (CN) ..... 202210331861.2

(51) Int. Cl.
*E01D 2/04* (2006.01)
*E01D 101/24* (2006.01)
*E01D 101/30* (2006.01)

(52) U.S. Cl.
CPC ..... *E01D 2/04* (2013.01); *E01D 2101/24* (2013.01); *E01D 2101/30* (2013.01)

(58) Field of Classification Search
CPC ..... E01D 2/02; E01D 2/04; E01D 19/125; E01D 21/00; E01D 2101/268; E01D 2101/30; E01D 2101/24; E01D 2101/284
See application file for complete search history.

(56) References Cited

U.S. PATENT DOCUMENTS

2019/0309488 A1* 10/2019 Li ..... E01D 19/067

FOREIGN PATENT DOCUMENTS

| | | | | |
|---|---|---|---|---|
| CN | 102352597 A | * | 2/2012 | |
| CN | 206553910 U | * | 10/2017 | |
| CN | 108677683 A | * | 10/2018 | ..... E01D 21/00 |
| CN | 109024221 A | * | 12/2018 | ..... E01D 2/04 |
| CN | 107856178 B | * | 8/2019 | ..... B28B 23/04 |

(Continued)

*Primary Examiner* — Abigail A Risic
(74) *Attorney, Agent, or Firm* — Nitin Kaushik

(57) ABSTRACT

A composite box girder structure and a construction method therefore. The composite box girder structure includes a box enclosure and an inner core, the inner core includes a thin-walled steel shell, shear connectors, and diaphragms, and the thin-walled steel shell is attached and fixed to an interior of the box enclosure by means of the shear connectors. The inner core and the box enclosure of the composite box girder structure jointly load force, such that effectiveness of the structure in resisting a use load can be improved. The inner core is directly used as an internal template of UHPC, such that rapid bridge construction can be achieved. Further, not only defects of conventional pouring can be overcome, but problems of excessive lateral local stress, overall stability, cross-section distortion and shear bearing capacity of web plates can be solved.

9 Claims, 13 Drawing Sheets

(56) References Cited

FOREIGN PATENT DOCUMENTS

| | | | | | |
|---|---|---|---|---|---|
| CN | 210013105 | U | | 2/2020 | |
| CN | 111305040 | A | * | 6/2020 | ..... E01D 11/04 |
| CN | 111501518 | A | | 8/2020 | |
| CN | 217974005 | U | | 12/2022 | |
| CN | 109338866 | B | * | 3/2024 | ..... E01D 2/04 |

* cited by examiner

COMPOSITE BOX GIRDER STRUCTURE AND CONSTRUCTION METHOD THEREFOR

CROSS-REFERENCE TO RELATED APPLICATIONS

The application claims priority to Chinese patent application No. 202210331861.2, filed on Mar. 30, 2022, the entire contents of which are incorporated herein by reference.

TECHNICAL FIELD

The present disclosure relates to the technical field of bridge engineering, and particularly relates to a composite box girder structure made of an inner core and a box enclosure, and a construction method therefor.

BACKGROUND

The prestressed concrete box girder bridge has been globally used because it is rapid to construct and high in economic performance. But the prestressed concrete box girder bridge with a larger span is faced with technical problems such as main span deflection, girder cracking and excessive self-weight. Traditional concrete is heavy in self-weight and low in strength, so the girder body made of such concrete tends to have a high risk of cracking under loads. Bearing capability of the bridge structure is mainly used to overcome its self-weight. Therefore, the conventional prestressed concrete box girder bridge cannot have a span greater than 300 m. Long-span prestressed concrete box girder bridges are prone to cracking and excessive mid-span deflection problems because of serious shrinkage and creeping of the normal concrete. Experts and scholars throughout the world prevent excessive deflection of the main span by setting a pre-camber and increasing prestressing tendons appropriately, and prevent cracking of web plates by applying vertical prestressing tendons. Further, they can reduce self-weight of the structure by using lightweight concrete or steel structure, so as to improve force on the structure. However, these methods can hardly fundamentally solve the above technical problems. In view of this, a composite box girder structure based on ultra-high performance concrete is expected to solve the above technical problems and enhance the spanning capability of the box girder bridge to a 500 m level.

The patent (ZL 201110345089.1) provides a prestressed ultra-high performance concrete continuous box girder structure based on ultra-high performance concrete (UHPC). However, the continuous box girder structure is internally provided with dense ultra-high performance concrete diaphragms, and the internal template of the box girder is blocked and disconnected by the diaphragms. Such arrangement makes the box girder construction process complicated. Moreover, ultra-high performance concrete diaphragms are likely to suffer from defects during pouring, which will influence the behavior of the whole structure. Therefore, an existing prestressed concrete continuous box girder bridge is structurally innovated by using light and strong ultra-high performance concrete. In this way, material performance is brought into full play, and construction problems are solved. Further, structural technical barriers can be fundamentally broken, the bridge technology level can be improved, rapid bridge construction can be achieved.

SUMMARY

The present disclosure provides a composite box girder structure and a construction method therefor, so as to solve technical problems of low effective bearing capacity of the box girder structure, a complicated internal template erection and demolition process and limited spanning capability during existing bridge engineering.

To solve the above technical problems, the present disclosure employs the following technical solutions.

A composite box girder structure includes a box enclosure and an inner core, where the inner core includes a thin-walled steel shell and shear connectors, and the thin-walled steel shell is attached and fixed to an interior of the box enclosure by means of the shear connectors.

The design idea of the technical solution is to form the box girder structure by combining the box enclosure and the inner core, such that the box enclosure and the inner core can jointly load force, and effective bearing capability of the structure is improved. In addition, the inner core has high strength, such that the thickness of the box enclosure can be reduced, the self-weight of the structure can be further reduced to prevent an excessive bending moment generated by the self-weight of the structure from influencing the bearing effect of the bridge, and further the span of the box girder bridge can be improved. Meanwhile, the inner core can be used as an internal template during pouring of the box enclosure, such that the manufacturing process of the composite box girder structure of the present disclosure is simplified, and production cost is reduced.

More preferably, in the technical solution, the inner core further includes diaphragms, and the diaphragms are fixed to inner side of the thin-walled steel shell in a cross-sectional direction of the inner core. The diaphragms at the inner side of the thin-walled steel shell and the thin-walled steel shell are integrated to jointly load force, such that stability of the inner core and bearing capability of the entire box girder structure are improved, problems of excessive transverse local stress, overall stability, cross-section distortion and shear bearing capacity of web plates of the ultra-high performance concrete thin-walled box girder can be comprehensively solved, and meanwhile, three-way prestressing tendons set by the traditional prestressed concrete box girder bridge can be changed into longitudinal one-way prestressing tendons.

More preferably, in the technical solution, the plurality of diaphragms are arranged at the inner side of the thin-walled steel shell in the longitudinal bridge direction, and an interval between every two adjacent diaphragms is 2 m-10 m.

More preferably, in the technical solution, the plurality of diaphragms are connected by several external prestressing tendons. The external prestressing tendons effectively connect the plurality of diaphragms of the box girder structure and diaphragms of different box girder segments, such that the box girder structure may jointly load force, so as to position and improve rigidity and bearing capability of an entire system.

More preferably, in the technical solution, the diaphragms are made of weathering resistant steel, and the diaphragms have a thickness of 0.008 m-0.020 m.

More preferably, in the technical solution, the thin-walled steel shell is made of weathering resistant steel, and the thin-walled steel shell has a thickness of 0.008 m-0.020 m.

More preferably, in the technical solution, the square-shaped thin-walled steel shell completely covers the inner surface of the box enclosure and is attached and fixed to it.

Alternatively, the n-shaped thin-walled steel shell partially covers the inner surface of the box enclosure and is attached and fixed to it. Since design spans and loading forms of bridges are different, structural shapes of the inner cores may be different accordingly. When the span of the bridge is large and bearing capability is required to be high, a box structure with a square-shaped thin-walled steel shell completely covers and supports the inner surface of the box enclosure. When the span of the bridge is small and bearing capability is required to be low, the thin-walled steel shell may only support and cover a direct force area in the upper half part of the inner surface of a box enclosure. In this way, production cost is reduced, and excess and waste of performance are avoided.

More preferably, in the technical solution, the shear connectors are several stud connectors, and the stud connectors have a diameter of 0.01 m-0.02 m and a height of 0.03 m-0.15 m; and the interval between the adjacent stud connectors is 0.15 m-0.40 m.

More preferably, in the technical solution, the box enclosure is composed of ultra-high performance concrete plates, and the box enclosure includes ultra-high performance concrete (UHPC) bridge deck, UHPC web plate, and UHPC bottom plate. The UHPC bridge deck has a thickness of 0.15 m-0.30 m, the UHPC web plate has a thickness of 0.10 m-0.60 m, and the UHPC bottom plate has a thickness of 0.15 m-1.50 m. The inner core and ultra-high performance concrete may be jointly used to significantly reduce the geometric size of the member, reduce the self-weight of the structure, improve effectiveness of the structure in resisting the use load, and enhance spanning capability of the bridge structure.

More preferably, in the technical solution, the inner core, the diaphragms, the UHPC bridge deck, the UHPC web plate and the UHPC bottom plate are all made of thin plates.

More preferably, in the technical solution, the ultra-high performance concrete is reactive powder concrete or ultra-high performance fiber reinforced concrete having a compressive strength not smaller than 100 MPa.

More preferably, in the technical solution, the UHPC bridge deck is in a shape of a flat plate or a one-way longitudinal rib plate. In the medium and small span bridge, the shape of the flat plate may be considered to be used. The larger the span is, the more obvious the longitudinal force effect of a main girder is. Compared with the rectangular flat plate, the bottom of the one-way longitudinal rib plate is partially hollowed out such that (1) internal prestressing tendons can be conveniently arranged; and (2) the bending moment of inertia is higher under the same cross-sectional area, and further the self-weight of the bridge deck can be significantly reduced.

More preferably, in the technical solution, the box enclosure is internally provided with the internal prestressing tendons in the longitudinal bridge direction, and alternatively, the box enclosure is internally provided with no prestressing tendons in the longitudinal bridge direction.

Based on the same technical concept, the present disclosure further provides a construction method for the above composite box girder structure. The construction method includes:

S1, welding thin-walled steel plates to form a thin-walled steel shell, welding shear connectors to the outer surfaces of the thin-walled steel shell at certain intervals, and welding diaphragms to the inner surfaces of the thin-walled steel shell at certain intervals, so as to form an inner core;

S2, erecting the external template of the box enclosure, and hanging the inner core in the external template of the box enclosure and fixing the inner core;

S3, forming the box enclosure through pouring, so as to form the composite box girder structure, and conducting high-temperature steam curing on the composite box girder structure;

S4, transporting the composite box girder structure to a mounting position, and erecting and assembling the composite box girder structure on site by using a girder hoisting device, so as to form a box girder bridge body structure; and S5, completing deck paving and ancillary works of the box girder bridge body structure, that is, completing construction.

More preferably, in the technical solution, in S3, when the box enclosure is formed through pouring, the inner core is used as an internal template.

Compared with the prior art, the present disclosure has the following advantages:

(1) According to the composite box girder structure of the present disclosure, the inner core is connected to the box enclosure by means of the shear connectors welded to the outer surface of the thin-walled steel shell, and the inner core and the box enclosure jointly load force, such that a plate thickness of the box enclosure can be further reduced, the self-weight of the structure can be reduced, the effectiveness of the structure in resisting the use load can be improved, a force state of the main girder can be improved, and the spanning capability of a continuous box girder bridge can be enhanced.

(2) According to the composite box girder structure of the present disclosure, the inner core and the box enclosure are integrated, the inner core can be directly used as the internal template of the box enclosure, different inner core shapes may be selected according to force characteristics of a specific bridge, no internal templates need to be erected or only part of the internal templates can be erected during construction, and the internal template is not blocked or disconnected by the steel diaphragms, such that an erection and demolition process is convenient, a problem that arrangement of diaphragms makes an erection and demolition process of an internal template of a box girder complicated in a traditional concrete box girder bridge is effectively solved, construction quality of the box girder structure is improved, and rapid bridge assembly and construction is achieved.

(3) The composite box girder structure of the present disclosure is internally provided with the steel diaphragms, such that not only pouring defects of conventional concrete diaphragms can be overcome, but problems of excessive lateral local stress, overall stability, cross-section distortion and shear bearing capacity of a UHPC web plate of a thin-walled box girder can be comprehensively solved; and meanwhile, three-way prestress set by a traditional prestressed concrete box girder bridge can be changed into longitudinal one-way prestress, such that force on the structure is simpler and clearer, and the structure has a wide application range and has broad application prospects.

(4) After high-temperature steam curing, the composite box girder structure of the present disclosure basically has no after shrinkage, with post-creep greatly reduced, such that technical problems of excessive deflection of a main span and a high cracking risk of the main girder can be effectively solved; and the ultra-high performance concrete is combined with the weathering resistant steel having atmospheric corrosion resistance, so as to ensure high durability of the box girder bridge.

Figure 1:
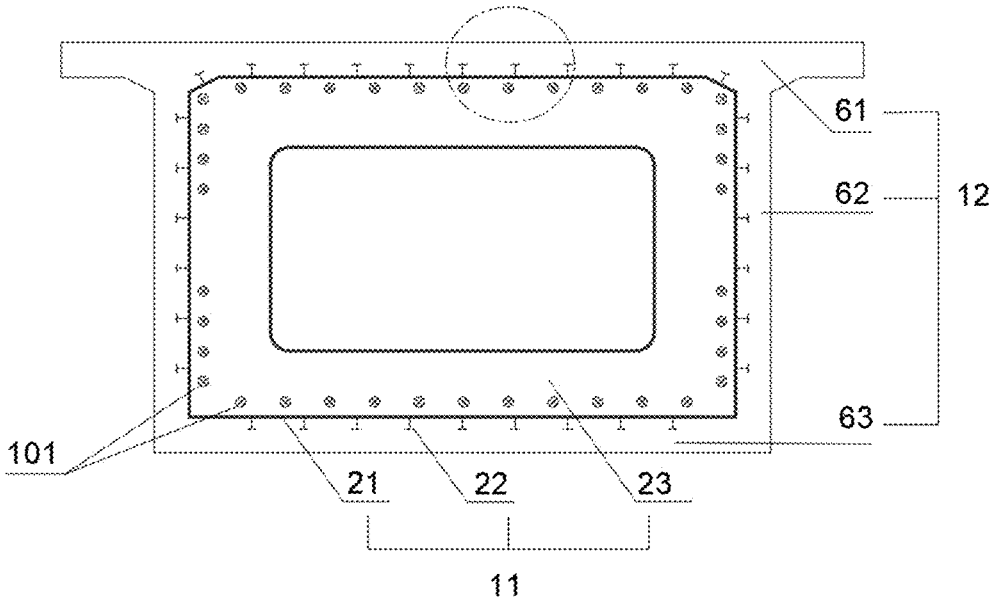
FIG. 1 is a schematic diagram of a sectional view of a composite box girder structure according to Embodiment 1.

REFERENCE NUMERALS 1, composite box girder structure; 11, inner core; 12, box enclosure; 21, thin-walled steel shell; 22, shear connector; 23, diaphragm; 61, UHPC bridge deck; 62, UHPC web plate; 63, UHPC bottom plate; 101, external prestressing tendon; and 102, internal prestressing tendon.

DETAILED DESCRIPTION OF THE EMBODIMENTS

The present disclosure will be described in detail below with reference to specific embodiments.

Embodiment 1

As shown in FIGS. 1-5, a composite box girder structure 1 of the embodiment includes a box enclosure 12 and an inner core 11. The inner core 11 includes a thin-walled steel shell 21, diaphragms 23, and shear connectors 22. The diaphragms 23 are fixed to an inner side of the thin-walled steel shell 21 in a cross-sectional direction of the inner core 11. The thin-walled steel shell 21 is attached and fixed to an interior of the box enclosure 12 by means of the shear connectors 22.

The thin-walled steel shell 21 is a box structure having a square-shaped section and completely covers and is attached and fixed to an inner surface of the box enclosure 12. The thin-walled steel shell 21 is made of weathering resistant steel, and the thin-walled steel shell 21 has a thickness of 0.008 m-0.015 m.

The plurality of diaphragms 23 are T-shaped steel plates, are arranged in a longitudinal bridge direction at intervals of 2 m-10 m, and have a thickness of 0.008 m-0.015 m. The diaphragms 23 are internally provided with external prestressing tendon channels and are connected by several external prestressing tendons 101.

The shear connectors 22 are stud connectors. The stud connectors have a diameter of 0.01 m-0.02 m and a height of 0.03 m-0.15 m. An interval between the adjacent stud connectors is 0.15 m-0.40 m.

Figure 2:
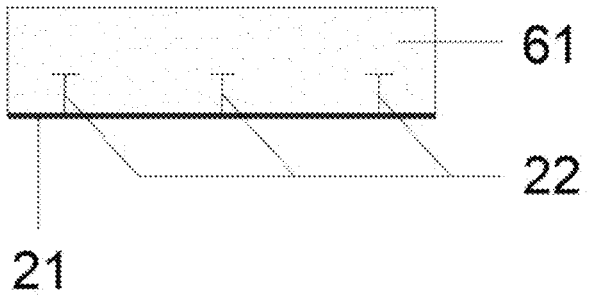
FIG. 2 is an enlarged view of an ultra-high performance concrete (UHPC) bridge deck in a circle part in FIG. 1.
Figure 3:
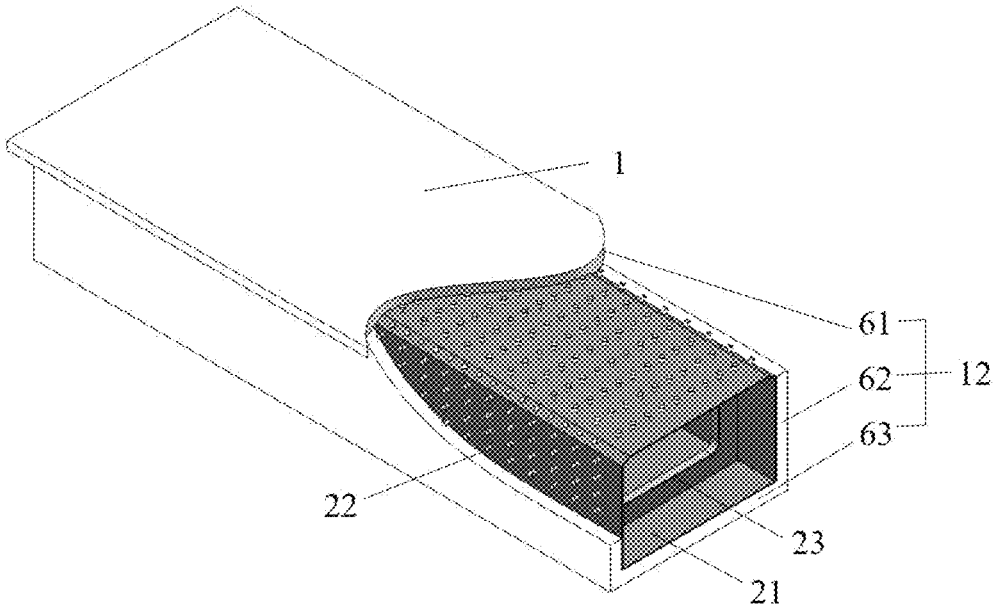
FIG. 3 is a schematic diagram of a three-dimensional structure of a sectional view of a UHPC bridge deck and a UHPC web plate of a composite box girder structure according to Embodiment 1.
Figure 4:
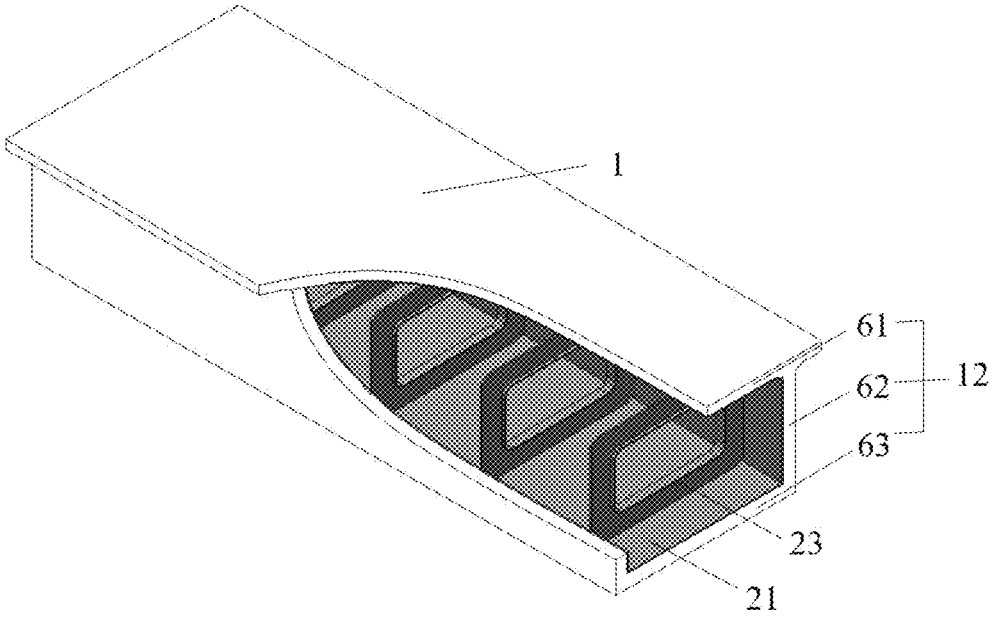
FIG. 4 is a schematic diagram of an internal three-dimensional structure of a box shape of a composite box girder structure according to Embodiment 1.
Figure 5:
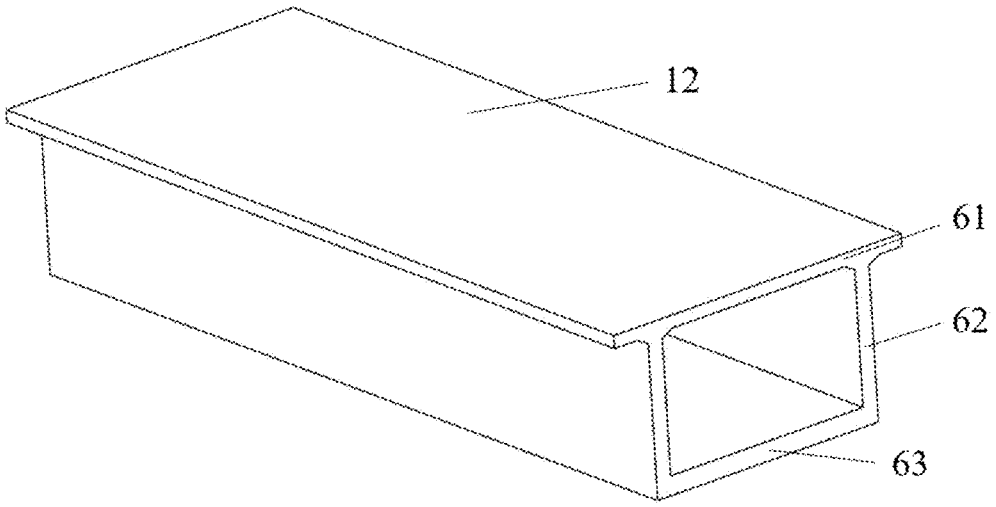
FIG. 5 is a schematic diagram of a three-dimensional structure of a box enclosure according to Embodiment 1.
Figure 6:
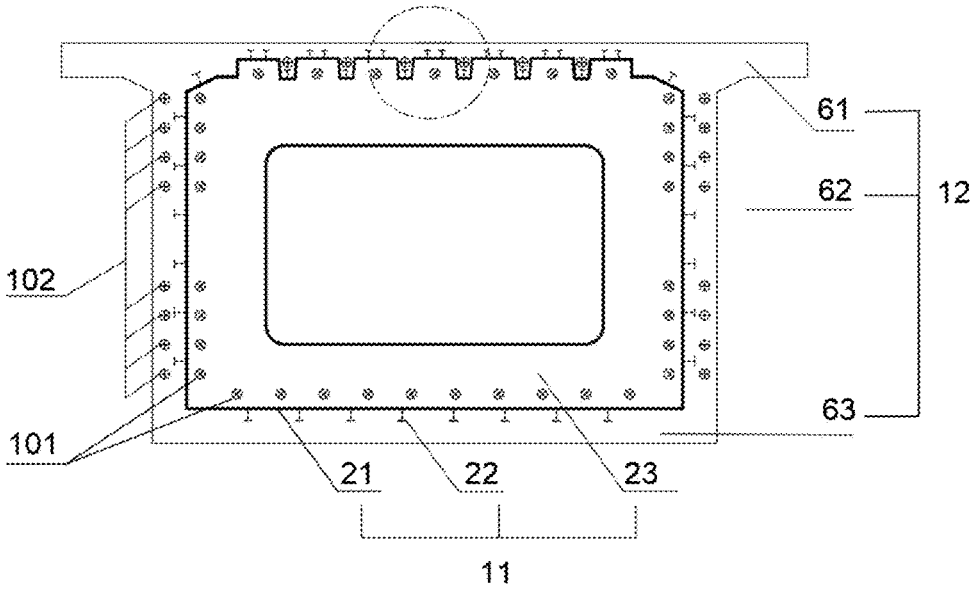
FIG. 6 is a schematic diagram of a sectional view of a composite box girder structure according to Embodiment 2.

The box enclosure 12 includes an ultra-high performance concrete (UHPC) bridge deck 61, a UHPC web plate 62, and a UHPC bottom plate 63. The UHPC bridge deck 61 has a thickness of 0.15 m-0.25 m. The UHPC web plate 62 has a thickness of 0.10 m-0.50 m. The UHPC bottom plate 63 has a thickness of 0.15 m-1.20 m. The UHPC bridge deck 61 is in a shape of a flat plate as shown in FIG. 2.

In the embodiment, the inner core 11, the diaphragms 23, the UHPC bridge deck 61, the UHPC web plate 62 and the UHPC bottom plate 63 are all made of thin plates.

A construction method for the composite box girder structure 1 according to the embodiment includes the following steps:

- S1: thin-walled steel plates are welded to form a thin-walled steel shell 21 in a prefabrication factory, and shear connectors 22 are welded to an outer surface of the thin-walled steel shell 21 at certain intervals, so as to form an inner core 11.
- S2: an external template of a box enclosure 12 is erected in the prefabrication factory, and the inner core 11 is hanged in the external template of the box enclosure 12 and fixed.
- S3: the inner core 11 is used as an internal template of the box enclosure 12, the box enclosure 12 is formed through pouring in the prefabrication factory, so as to form a segment of the composite box girder structure 1 of the embodiment, and high-temperature steam curing is conducted on the segment of the composite box girder structure 1.
- S4: the segment of the composite box girder structure 1 is transported to a mounting position by using a girder transporting vehicle, the composite box girder structure is erected by using a girder hoisting device, all segments of the composite box girder structure 1 are assembled on site, and prestressing tendons are sequentially tensioned.
- S5: deck paving and ancillary works of a box girder bridge are completed, that is, construction is completed.

Embodiment 2

As shown in FIGS. 6-9, a composite box girder structure 1 of the embodiment includes a box enclosure 12 and an inner core 11. The inner core 11 includes a thin-walled steel shell 21, diaphragms 23, and shear connectors 22. The diaphragms 23 are fixed to an inner side of the thin-walled steel shell 21 in a cross-sectional direction of the inner core 11. The thin-walled steel shell 21 is attached and fixed to an interior of the box enclosure 12 by means of the shear connectors 22.

The thin-walled steel shell 21 is a box structure having a square-shaped section and completely covers and is attached and fixed to an inner surface of the box enclosure 12. The thin-walled steel shell 21 is made of weathering resistant steel, and the thin-walled steel shell 21 has a thickness of 0.008 m-0.020 m.

The plurality of diaphragms 23 are T-shaped steel plates, are arranged in a longitudinal bridge direction at intervals of 2 m-10 m, and have a thickness of 0.008 m-0.020 m. The diaphragms 23 are internally provided with external prestressing tendon channels and are connected by several external prestressing tendons 101.

The shear connectors 22 are stud connectors. The stud connectors have a diameter of 0.01 m-0.02 m and a height of 0.03 m-0.15 m. An interval between the adjacent stud connectors is 0.15 m-0.40 m.

Figure 7:
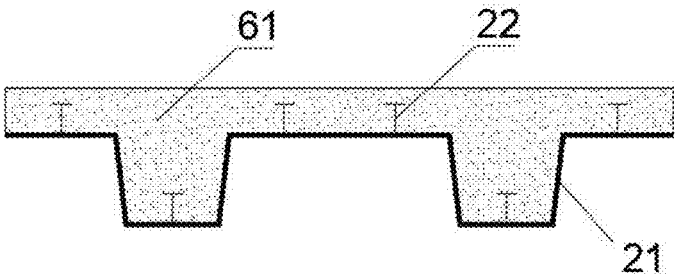
FIG. 7 is an enlarged view of a UHPC bridge deck in a circle part in FIG. 6.
Figure 8:
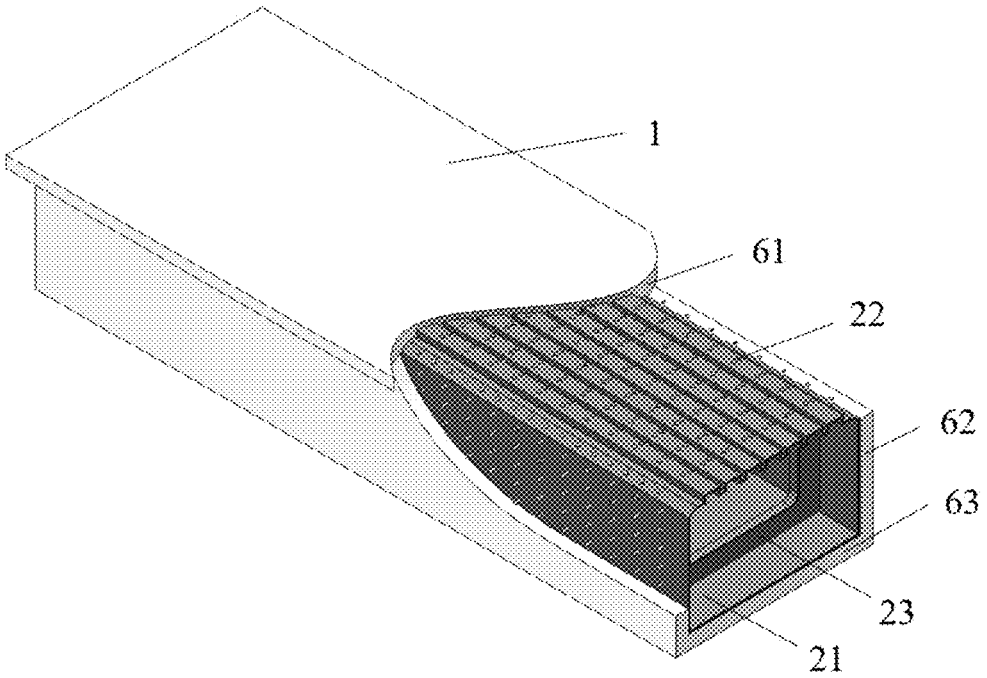
FIG. 8 is a schematic diagram of a three-dimensional structure of a sectional view of a UHPC bridge deck and a UHPC web plate of a composite box girder structure according to Embodiment 2.
Figure 9:
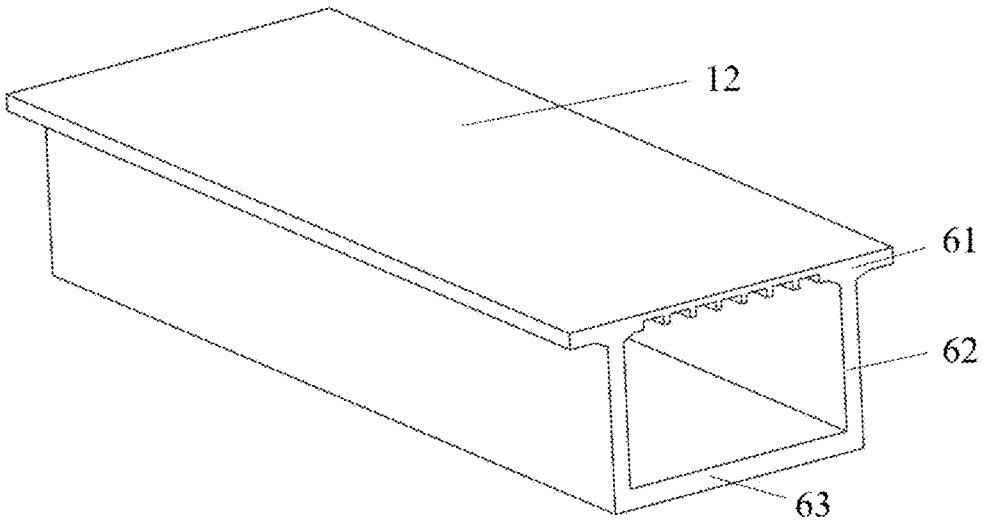
FIG. 9 is a schematic diagram of a three-dimensional structure of a box enclosure according to Embodiment 2.

The box enclosure 12 includes a UHPC bridge deck 61, a UHPC web plate 62, and a UHPC bottom plate 63. The box enclosure 12 is internally provided with internal prestressing tendons 102 in the longitudinal bridge direction. The UHPC bridge deck 61 has a thickness of 0.15 m-0.30 m. The UHPC web plate 62 has a thickness of 0.10 m-0.60 m. The UHPC bottom plate 63 has a thickness of 0.15 m-1.50 m. As shown in FIGS. 7 and 9, the UHPC bridge deck 61 is in a shape of a one-way longitudinal rib plate, and the UHPC web plate 62 and the UHPC bottom plate 63 are both in a shape of a flat plate.

In the embodiment, the inner core 11, the diaphragms 23, the UHPC bridge deck 61, the UHPC web plate 62 and the UHPC bottom plate 63 are all made of thin plates.

A construction method for the composite box girder structure 1 according to the embodiment is the same as the construction method according to Embodiment 1.

Embodiment 3

Figure 10:
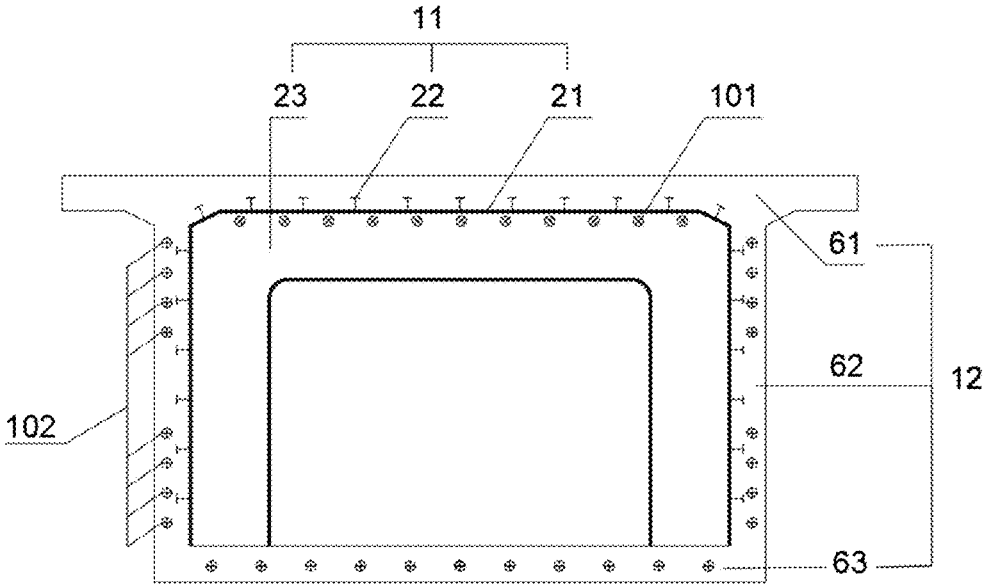
FIG. 10 is a schematic diagram of a sectional view of a composite box girder structure according to Embodiment 3.
Figure 11:
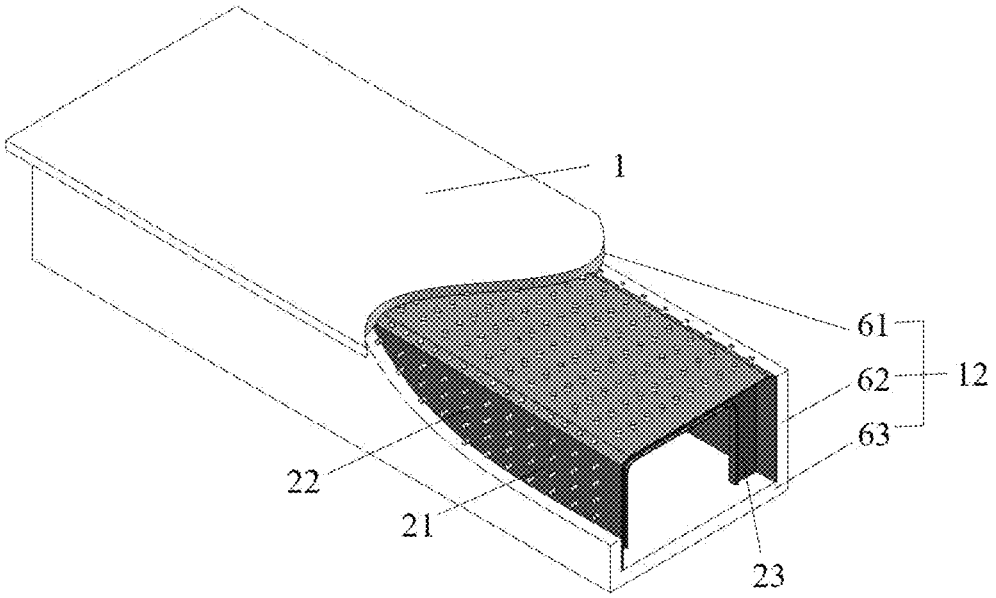
FIG. 11 is a schematic diagram of a three-dimensional structure of a sectional view of a UHPC bridge deck and a UHPC web plate of a composite box girder structure according to Embodiment 3.

As shown in FIGS. 10 and 11, a composite box girder structure 1 of the embodiment includes a box enclosure 12 and an inner core 11. The inner core 11 includes a thin-walled steel shell 21, diaphragms 23, and shear connectors 22. The diaphragms 23 are fixed to an inner side of the thin-walled steel shell 21 in a cross-sectional direction of the inner core 11. The thin-walled steel shell 21 is attached and fixed to an interior of the box enclosure 12 by means of the shear connectors 22.

The thin-walled steel shell 21 is a structure having an n-shaped section and completely covers and is attached and fixed to inner surfaces of a UHPC bridge deck 61 and a UHPC web plate 62. The thin-walled steel shell 21 is made of weathering resistant steel, and the thin-walled steel shell 21 has a thickness of 0.008 m-0.015 m.

The plurality of diaphragms 23 are T-shaped steel plates, are arranged in a longitudinal bridge direction at intervals of 2 m-10 m, and have a thickness of 0.008 m-0.015 m. The diaphragms 23 are internally provided with external prestressing tendon channels and are connected by several external prestressing tendons 101.

The shear connectors 22 are stud connectors. The stud connectors have a diameter of 0.01 m-0.02 m and a height of 0.03 m-0.15 m. An interval between the adjacent stud connectors is 0.15 m-0.40 m.

The box enclosure 12 includes the UHPC bridge deck 61, the UHPC web plate 62, and a UHPC bottom plate 63. The box enclosure 12 is internally provided with internal prestressing tendons 102 in the longitudinal bridge direction. The UHPC bridge deck 61 has a thickness of 0.15 m-0.25 m. The UHPC web plate 62 has a thickness of 0.10 m-0.50 m. The UHPC bottom plate 63 has a thickness of 0.15 m-1.20 m. The UHPC bridge deck 61 is in a shape of a flat plate.

In the embodiment, the inner core 11, the diaphragms 23, the UHPC bridge deck 61, the UHPC web plate 62 and the UHPC bottom plate 63 are all made of thin plates.

A construction method for the composite box girder structure 1 according to the embodiment includes the following steps:

S1: thin-walled steel plates are welded to form a thin-walled steel shell 21 in a prefabrication factory, and shear connectors 22 are welded to an outer surface of the thin-walled steel shell 21 at certain intervals, so as to form an inner core 11.

S2: an external form of a box enclosure 12 is erected in the prefabrication factory, and the inner core 11 is hanged in the external form of the box enclosure 12 and fixed.

S3: the inner core 11 is used as part of an internal form of the box enclosure 12, an internal form of a UHPC bottom plate 63 is erected, the box enclosure 12 is formed through pouring in the prefabrication factory, so as to form a segment of the composite box girder structure 1 of the embodiment, and high-temperature steam curing is conducted on the segment of the composite box girder structure 1.

S4: the segment of the composite box girder structure 1 is transported to a mounting position by using a girder transporting vehicle, the composite box girder structure is erected by using a girder hoisting device, all segments of the composite box girder structure 1 are assembled on site, and prestressing tendons are sequentially tensioned.

S5: deck paving and ancillary works of a box girder bridge are completed, that is, construction is completed.

Embodiment 4

Figure 12:
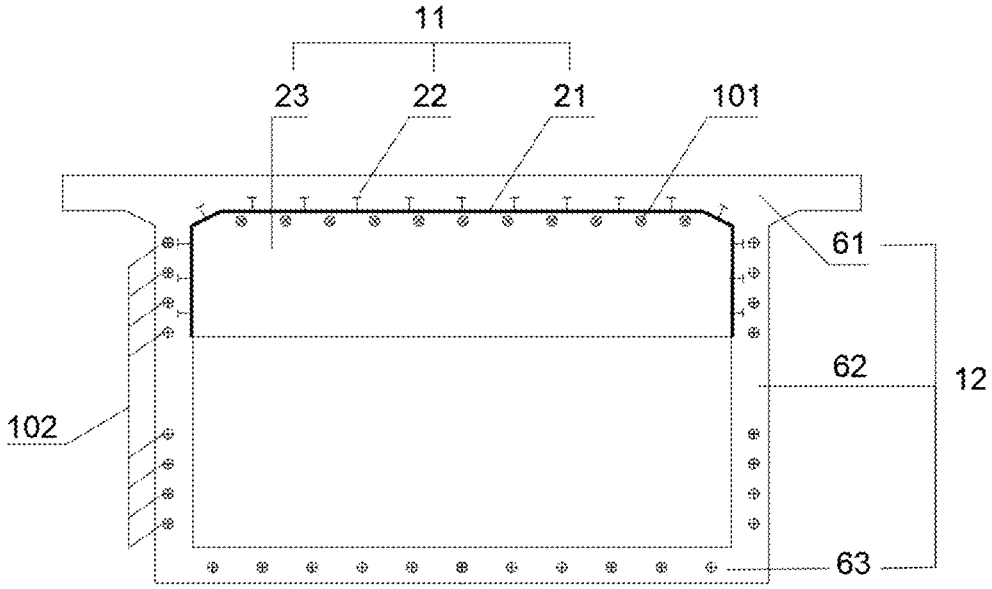
FIG. 12 is a schematic diagram of a sectional view of a composite box girder structure according to Embodiment 4.
Figure 13:
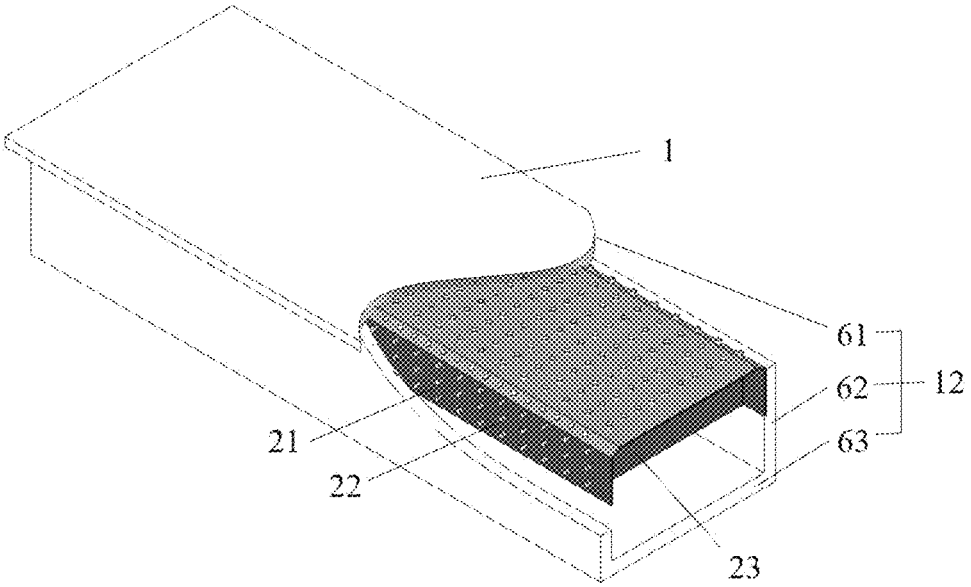
FIG. 13 is a schematic diagram of a three-dimensional structure of a sectional view of a UHPC bridge deck and a UHPC web plate of a composite box girder structure according to Embodiment 4.

As shown in FIGS. 12 and 13, a composite box girder structure 1 of the embodiment includes a box enclosure 12 and an inner core 11. The inner core 11 includes a thin-walled steel shell 21, diaphragms 23, and shear connectors 22. The diaphragms 23 are fixed to an inner side of the thin-walled steel shell 21 in a cross-sectional direction of the inner core 11. The thin-walled steel shell 21 is attached and fixed to an interior of the box enclosure 12 by means of the shear connectors 22.

The thin-walled steel shell 21 is a structure having an n-shaped section and covers and is attached and fixed to an entire inner surface of a UHPC bridge deck 61 and an upper part of an inner surface of a UHPC web plate 62. The thin-walled steel shell 21 is made of weathering resistant steel, and the thin-walled steel shell 21 has a thickness of 0.008 m-0.015 m.

The plurality of diaphragms 23 are T-shaped steel plates, are arranged in a longitudinal bridge direction at intervals of 2 m-10 m, and have a thickness of 0.008 m-0.015 m. The diaphragms 23 are internally provided with external prestressing tendon channels and are connected by several external prestressing tendons 101.

The shear connectors 22 are stud connectors. The stud connectors have a diameter of 0.01 m-0.02 m and a height of 0.03 m-0.15 m. An interval between the adjacent stud connectors is 0.15 m-0.40 m.

The box enclosure 12 includes the UHPC bridge deck 61, the UHPC web plate 62, and a UHPC bottom plate 63. The box enclosure 12 is internally provided with internal prestressing tendons 102 in the longitudinal bridge direction. The UHPC bridge deck 61 has a thickness of 0.15 m-0.25 m. The UHPC web plate 62 has a thickness of 0.10 m-0.50 m. The UHPC bottom plate 63 has a thickness of 0.15 m-1.20 m. The UHPC bridge deck 61 is in a shape of a flat plate.

In the embodiment, the inner core 11, the diaphragms 23, the UHPC bridge deck 61, the UHPC web plate 62 and the UHPC bottom plate 63 are all made of thin plates.

A construction method for the composite box girder structure 1 according to the embodiment includes the following steps:

S1: thin-walled steel plates are welded to form a thin-walled steel shell 21 in a prefabrication factory, and shear connectors 22 are welded to an outer surface of the thin-walled steel shell 21 at certain intervals, so as to form an inner core 11.

S2: an external form of a box enclosure 12 is erected in the prefabrication factory, and the inner core 11 is hanged in the external form of the box enclosure 12 and fixed.

S3: the inner core 11 is used as part of an internal form of the box enclosure 12, internal forms of a UHPC web plate 62 and a UHPC bottom plate 63 are erected, the box enclosure 12 is formed through pouring in the prefabrication factory, so as to form a segment of the composite box girder structure 1 of the embodiment, and high-temperature steam curing is conducted on the segment of the composite box girder structure 1.

S4: the segment of the composite box girder structure 1 is transported to a mounting position by using a girder transporting vehicle, the composite box girder structure is erected by using a girder hoisting device, all segments of the composite box girder structure 1 are assembled on site, and prestressing tendons are sequentially tensioned.

S5: deck paving and ancillary works of a box girder bridge are completed, that is, construction is completed.

Merely preferred implementation modes of the present disclosure are described above, and the protection scope of the present disclosure is not limited to the above embodiments. Improvements and modifications obtained by those skilled in the art without departing from the technical concept of the present disclosure should be regarded as falling within the scope of the present disclosure.

What is claimed is:

1. A composite box girder structure, comprising a box enclosure (12) and an inner core (11), wherein the inner core (11) comprises a thin-walled steel shell (21) and shear connectors (22), and the thin-walled steel shell (21) is attached and fixed to an interior of the box enclosure (12) by means of the shear connectors (22);

the inner core (11) further comprises diaphragms (23), the diaphragms (23) are fixed to an inner side of the thin-walled steel shell (21) in a cross-sectional direction of the inner core (11), the plurality of diaphragms (23) are arranged at the inner side of the thin-walled steel shell (21) in a longitudinal bridge direction;

when the span of the bridge is small and bearing capability is required to be low, the n-shaped thin-walled steel shell (21) partially covers and is attached and fixed to an inner surface of the ultra-high performance concrete box enclosure (12);

the n-shaped diaphragms (23) are fixed to the inner side of the n-shaped thin-walled steel shell (21).

2. The composite box girder structure according to claim 1, wherein an interval between every two adjacent diaphragms (23) is 2 m-10 m.

3. The composite box girder structure according to claim 2, wherein the diaphragms (23) are made of weathering resistant steel, the diaphragms (23) have a thickness of 0.008 m-0.020 m, and the plurality of diaphragms (23) are connected by several external prestressing tendons (101).

4. The composite box girder structure according to claim 1, wherein the thin-walled steel shell (21) is made of weathering resistant steel, and the thin-walled steel shell (21) has a thickness of 0.008 m-0.020 m.

5. The composite box girder structure according to claim 1, wherein the box enclosure (12) is composed of ultra-high performance concrete plates, and ultra-high performance concrete is reactive powder concrete or ultra-high-performance fiber reinforced concrete having a compressive strength of not smaller than 100 MPa; and the box enclosure (12) comprises an ultra-high performance concrete (UHPC) bridge deck (61), a UHPC web plate (62), and a UHPC bottom plate (63), wherein the UHPC bridge deck (61) has a thickness of 0.15 m-0.30 m, the UHPC web plate (62) has a thickness of 0.10 m-0.60 m, and the UHPC bottom plate (63) has a thickness of 0.15 m-1.50 m.

6. The composite box girder structure according to claim 5, wherein the UHPC bridge deck (61) is in a shape of a flat plate or a one-way longitudinal rib plate.

7. The composite box girder structure according to claim 1, wherein the box enclosure (12) is internally provided with internal prestressing tendons (102) in the longitudinal bridge direction.

8. A construction method for the composite box girder structure according to claim 2, comprising the following steps:

S1, welding thin-walled steel plates to form a thin-walled steel shell (21), welding shear connectors (22) to an outer surface of the thin-walled steel shell (21) at certain intervals, and welding diaphragms (23) to an inner surface of the thin-walled steel shell (21) at certain intervals, so as to form an inner core (11);

S2, erecting an external form of a box enclosure (12), and hanging the inner core (11) in the external form of the box enclosure (12) and fixing the inner core;

S3, forming the box enclosure (12) through pouring, so as to form the composite box girder structure (1), and conducting high-temperature steam curing on the composite box girder structure (1);

S4, transporting the composite box girder structure (1) to a mounting position, and erecting and assembling the composite box girder structure on site by using a girder hoisting device, so as to form a box girder bridge body structure; and S5, completing deck paving and ancillary works of the box girder bridge body structure, that is, completing construction.

9. The construction method for the composite box girder structure according to claim 8, wherein in S3, when the box enclosure (12) is formed through pouring, the inner core (11) is used as an internal form.

* * * * *